United States Patent [19]

Sano et al.

[11] 4,417,375

[45] Nov. 29, 1983

[54] APPARATUS FOR INTERLACING MULTIFILAMENT YARN BY FLUID

[75] Inventors: Takao Sano; Masafumi Ogasawara, both of Otsu; Hiroshi Tsubakimori, Kyoto, all of Japan

[73] Assignee: Toray Industries, Inc., Tokyo, Japan

[21] Appl. No.: 144,031

[22] Filed: Apr. 28, 1980

Related U.S. Application Data

[63] Continuation of Ser. No. 888,666, Mar. 21, 1978, abandoned.

[30] Foreign Application Priority Data

Mar. 30, 1977 [JP] Japan ..... 52-34658
Mar. 30, 1977 [JP] Japan ..... 52-34660

[51] Int. Cl.[3] ..... D02G 1/16; D02J 1/08
[52] U.S. Cl. ..... 28/272; 28/275
[58] Field of Search ..... 28/271, 274, 275, 276, 28/272; 57/350

[56] References Cited

U.S. PATENT DOCUMENTS

| | | | |
|---|---|---|---|
| 2,895,995 | 5/1961 | Bunting, Jr. et al. | 28/276 X |
| 3,167,847 | 2/1965 | Gonsalves | 28/275 |
| 3,262,179 | 7/1966 | Sparling | 28/274 |
| 3,363,294 | 1/1968 | Jeurissen et al. | 28/275 X |
| 3,394,440 | 7/1968 | Van Holten | 28/275 |
| 3,407,583 | 10/1968 | Irwin et al. | 28/271 X |
| 3,417,445 | 12/1968 | Gemeinhardt et al. | 28/275 |
| 3,422,516 | 1/1969 | Barlow et al. | 28/274 |
| 3,478,398 | 11/1969 | Barlow et al. | 28/274 |
| 3,534,453 | 10/1970 | Lefebvre | 28/274 |
| 3,636,601 | 1/1972 | Barlow et al. | 28/274 |
| 3,695,025 | 10/1972 | Gibbon | 28/274 X |
| 3,854,313 | 12/1974 | Heichlinger et al. | 57/350 X |

*Primary Examiner*—Robert Mackey
*Attorney, Agent, or Firm*—Austin R. Miller

[57] ABSTRACT

Apparatus for imparting a good cohering property to a multifilament yarn by applying a continuous main jet stream of a fluid to a running multifilament yarn in a yarn treating zone, while impinging a subsidiary jet stream having a discontinuous pressure wave against the above-mentioned continuous main jet stream so as to expose the running multifilament yarn to the impinging jet stream having a resonance sharpness of at least 2 at the position outlet aperture of the yarn treating zone.

8 Claims, 24 Drawing Figures

Fig. 8A
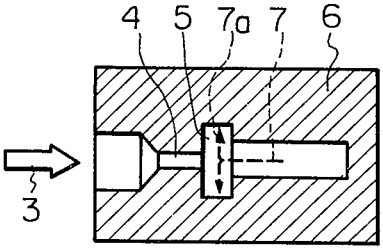
Fig. 8B
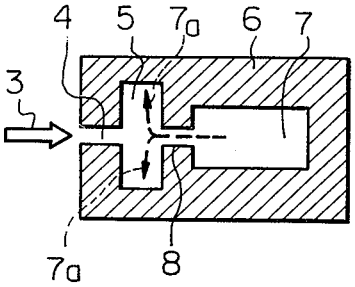
Fig.8C
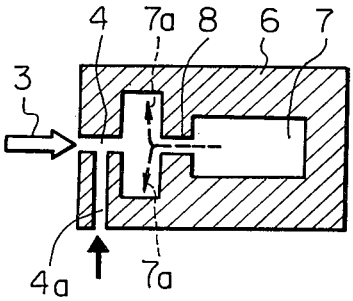
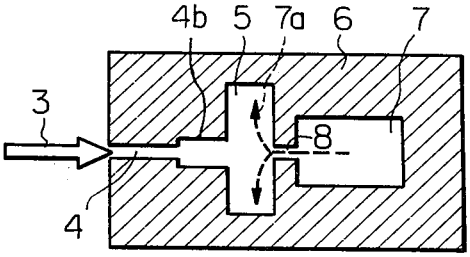
Fig. 9
Fig. 10
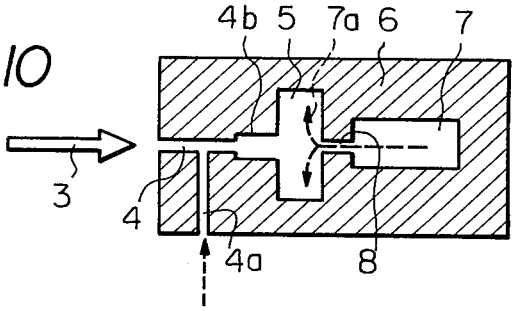

APPARATUS FOR INTERLACING MULTIFILAMENT YARN BY FLUID

This is a continuation, of application Ser. No. 888,666, filed Mar. 21, 1978, now abandoned.

BACKGROUND OF THE INVENTION

The present invention relates to an apparatus for imparting good coherency characteristic to a running multifilament yarn by applying jet streams of a fluid thereto, so that yarn-constituting individual-filaments, are interlaced with one another. More particularly, the invention relates to a fluid treatment apparatus by which an improved coherence can be effectively imparted to a running multifilament yarn by utilizing a reduced quantity of a jetting fluid.

A method for the interlacing treatment by means of jetting a fluid to a running multifilament yarn is known as disclosed in the specifications of U.S. Pat. Nos. 2,985,995, 3,110,151 and 3,167,847. As a result of intensive research conducted on this known method, it was found that jet streams do not always promote interlacing of individual filaments of the yarn, but provide an interlacing effect only for a limited time under certain conditions. Thus, it has been confirmed that the working efficiency of this conventional method is very poor.

SUMMARY OF THE INVENTION

It is, therefore, a primary object of the present invention to provide an apparatus for the fluid treatment of a running multifilament yarn in which the poor working efficiency to the conventional technique is eliminated, and an interlacing effect is attained at a very high efficiency by utilizing a very reduced quantity of jet stream energy.

In accordance with the present invention, the above-mentioned object can be attained by a method of fluid treatment for running multifilament yarn comprising applying continuous main jet stream of a fluid to a running multifilament yarn to interlace the individual filaments thereof with one anohter and impart a cohering property to the running multifilament yarn, wherein a subsidiary jet stream having a discontinuous pressure wave is caused to impinge against the continuous main jet stream. The running multifilament yarn is exposed to the impinging jet streams.

By the term "stream having a discontinuous pressure wave" as used in this specification and appended claims, it is meant a stream having an oscillation frequency in an audio frequency region, namely an oscillation frequency below 2000 Hz.

According to the method of the present invention for attaining the above-mentioned object, in a yarn treating zone having its circumference surrounded, a subsidiary jet stream having a periodically discontinuous pressure wave (hereinafter referred to as "subsidiary stream") is caused to impinge against a main jet stream to form an impinging stream having a resonance sharpness (quality factor Q) of at least 2. The running yarn traverses the main jet stream and turbulences and eddys generated by impingement of the subsidiary stream against the main stream are positively utilized for interlacing the individual filaments, whereby the energy possessed by the jetting fluid is more efficiently used for interlacing the individual yarn filaments with each other.

The apparatus for carrying out this method comprises a yarn treating zone having its circumference surrounded, into which a multifilament yarn to be treated is introduced, and at least two fluid supply nozzles opened to the yarn treating zone, one of those nozzles being a main nozzle for jetting a continuous main jet stream and the other nozzle being a subsidiary nozzle for generating a discontinuous pressure wave, wherein said main and subsidiary nozzles are arranged so that the axial lines of the main and subsidiary nozzles meet each other in the yarn treating zone resulting in a yarn treating jet stream which has an oscillation of resonance sharpness (quality factor Q) of at least 2.

BRIEF DESCRIPTION OF THE DRAWING

FIGS. 8A, 8B and 8C are transversal cross-sectional views of yarn treating devices, with each device having a fluid oscillator therein disposed, according to the present invention.

FIG. 9 is a transversal cross-sectional view of a yarn treating device, wherein a main nozzle for ejecting a main air jet stream into a yarn treating zone and a fluid oscillator are combined, according to the present invention.

FIGS. 10 and 11 are transversal cross-sectional views of a modification of the yarn treating device in FIG. 9, wherein a fluid introducing aperture is formed in the device so as to connecte with the main nozzle, according to the present invention.

DETAILED DESCRIPTION OF THE PREFERRED EMBODIMENTS

For the purpose of explaining the present invention, behavior of a multifilament yarn subjected to a continuous jet stream will first be described.

As a result experiments performed for providing an understanding of the interlacing phenomenon (using high-speed photography and the like), the inventors found that, when a continuous jet stream is applied to a running multifilament yarn, the individual filaments spread apart and also interlacing of individual filaments results as the yarn traverses the jet stream. It was also found that the multifilament yarn's individual filaments perform indefinite movements independently of the force of the fluid and they thus entangle with one another, resulting in interlacing among the individual filaments.

Figure 1A:
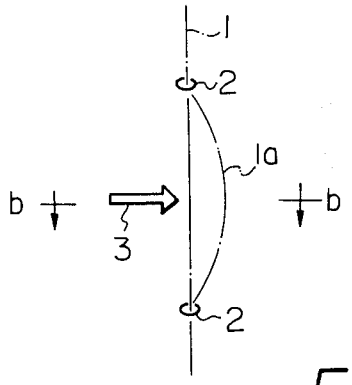
Fig. 1A (PRIOR ART)
FIG. 1A is a schematic view representing the running behavior of a yarn onto which an air jet stream impinges.
Figure 1B:
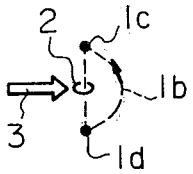
Fig. 1B (PRIOR ART)
FIG. 1B is a schematic view representing the trace of the running yarn transversally taken along a plane parallel to the ejection direction of the air jet stream.
Figure 1C:
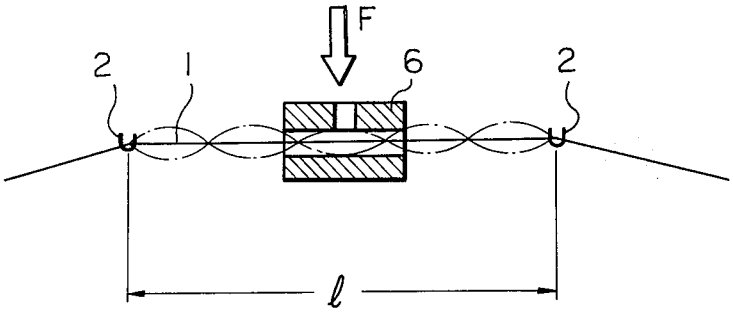
Fig. 1C (PRIOR ART)
FIG. 1C is a schematic view representing the running behavior of a yarn between two guides while running through an interlacing device wherein an air jet stream is ejected.

As shown in FIGS. 1A, 1B and 1C, when a jet stream 3 is applied to a multifilament yarn 1, in general, the yarn 1 is displaced by the fluid force of the jet stream 3 in the direction along which the jet stream 3 is applied, as indicated by broken line 1-A. The yarn is under maximum tension as it encounters the center of the jet stream as indicated by 1*b* in FIG. 1-B. Then, the yarn shifts in such a direction that the tension is moderated by the restoring force generated by the elasticity of the yarn. At this point, whether the yarn 1 shifts toward one side 1*c* of the line of the jet stream 3 on the drawing of FIG. 1B or toward the other side 1*d* of the line of the jet stream 3 on the drawing of FIG. 1B is based upon such factors as the yarn tension and the direction of the jet stream applied to the yarn. In short, the shifting direction of the yarn is indefinite. As the yarn tension is then reduced, the yarn 1 is moved to the center of the fluid again by the dragging fluid force of the jet stream 3, and the above vibration phenomenon of the yarn 1 is repeated. The vibrating yarn movement resembles a sinusoidal wave. It has been confirmed that according to the conventional treatment, the yarn 1 has only a poor chance to traverse from the upper side 1*c* of the line of the jet stream 3 on the drawing of FIG. 1B to the opposite side 1*d* thereof and cross the jet stream 3. More specifically, in the conventional treatment method, since the force directed to the running yarn by the jet stream 3 during the interlacing treatment is larger than the above-mentioned restoring force, it is difficult for the yarn to traverse the jet stream, and as a result, the yarn performs a sinusoidal oscillation in a region on one side of the jet stream which is subbstantially in parallel to the jetting direction of the jet stream as indicated by 1*b*~1*c* or 1*b*~1*d* in FIG, 1B.

Of course, it is in the central portion of the jet stream that the yarn receives the strongest jetting force. However, as mentioned above, in the actual operation, the chance that the running yarn is exposed to the central portion of the jet stream is very small. Accordingly, the proportion of the energy utilized for interlacing the individual filaments of the yarn to the energy possessed by the jet stream is very low.

Figure 2A:
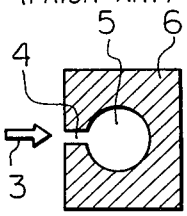
Fig.2A (PRIOR ART)
FIGS. 2A, 2B and 2C are transversal cross-sectional views of conventional devices for interlacing a multifilament yarn.
Figure 2B:
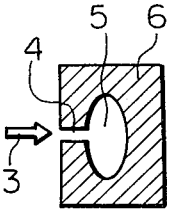
Fig.2B (PRIOR ART)
Figure 2C:
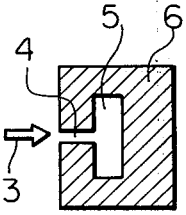
Fig.2C (PRIOR ART)

Referring to FIGS. 2A, 2B and 2C, examples of conventional interlacing apparatus are shown for the fluid treatment of multifilament yarn. A jet stream outlet 4 is formed through a body member 6. A jet stream emitted from the jet stream outlet 4 impinges against the wall of an aperture which extends through member 6, and a multifilament yarn moves through the aperture which is the yarn treating zone having either a circular, elliptical or rectangular cross-section. There is a possibility that the yarn 1 will traverse the jet stream 3 as a result of the dragging force or eddy currents generated by impingement of the jet stream against the wall of the aperture, but it is impossible to recognize and determine quantitatively an effective action of these eddys forcing the multifilament yarn 1 to traverse the jet stream 3. Further, it is quite natural that the directional flow of these eddys would be changed if the shape and size of the yarn treating zone differs, and the generation state of eddys is unsteady. Therefore, it cannot be expected that the eddys will always exert a sufficient force to force the yarn to traverse the jet stream.

However, it is considered that generation of the above-mentioned eddys will have a great influence on the state of entanglement among individual filaments of the yarn. Accordingly, it is believed that eddys generated in the yarn treating zone 5 do not exert a force which forces the yarn running in the treating zone 5 to traverse the jet stream, but that they perform an action of imparting independent movements to respective individual filaments and they thereby determine the entanglement state of individual filaments by this action.

The inventors conducted further research based on the foregoing observations and, as a result, completed the present invention. According to the present invention, in a yarn treating zone, a subsidiary jet stream having a periodically discontinuous pressure wave is caused to impinge against a main jet stream to form a resulting stream having a resonance sharpness (quality factor Q) of at least 2, so that the running yarn can traverse the main jet stream assuredly, and turbulences and eddys generated by impingement of the subsidiary jet stream against the main jet stream are positively utilized for interlacing of individual filaments, whereby the energy possessed by the jetted fluid can be effectively used at a high efficiency for interlacing the yarn-constituting individual filaments with one another. According to this method, there can be obtained an interlaced multifilament yarn with a good cohering quality, as compared to an interlaced multifilament yarn formed according to the conventional fluid treatment in the yarn quality, while the fluid energy is utilized very effectively. Therefore, it has been found that this method is very advantageous from an economical point of view. As a result of investigations based on this basic technical concept, the inventors have succeeded in developing a practical yarn treating apparatus for carrying out the above yarn treating method for production of an interlaced multifilament yarn.

In the present invention, it is important that a discontinuous subsidiary jet stream impinge against a continuous main jet stream. For example, Japanese Patent Publication No. 28533/75 (U.S. Pat. No. 3,563,021) discloses a mechanical process in which a running multifilament yarn is traversed merely mechanically in a direction perpendicular to the running direction thereof, so that the running yarn can cross the main jet stream. As a result of the inventors' experiments, it was confirmed that this mechanical process has no substantial effect of enhancing the degree of interlacing. In this known process, especially when the treatment tension is lowered, because of too strong a force of the jetting fluid, the running yarn will assuredly not traverse the main jet stream. Further, when the treatment tension is high, the running yarn can traverse the main jet stream, but the freedom among individual filaments of the multifilament yarn is restricted and spacing apart the individual-filaments of the yarn becomes difficult, with the result that it is difficult to enhance the inerlacing effect substantially.

The structure and functional effect of the present invention will now be described by reference to embodiments illustrated in the accompanying drawing.

Figure 3A:
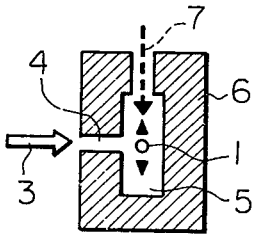
FIGS. 3A and 3B are transversal cross-sectional views of the yarn treating devices according to the present invention.
Figure 3B:
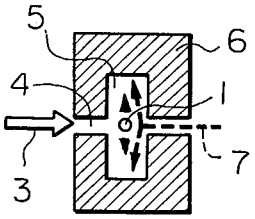
Figure 4:
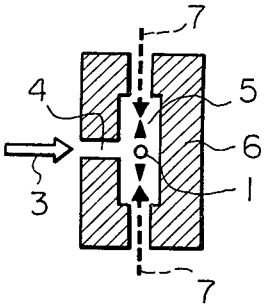
FIG. 4 is a transversal cross-sectional view of another yarn treating device according to the present invention.

A yarn treating apparatus shown in FIGS. 3A, 3B and 4 is first described.

FIGS. 3A and 3B illustrate an embodiment in which a main jet stream 3 of continuous flow is introduced into a yarn treating zone 5 formed in a yarn treating member 6 of the apparatus and, simultaneously, a subsidiary jet stream 7 of a discontinuous pressure wave is introduced into the treating zone 5 in a direction lateral or opposite to the introduction direction of the main jet stream 3, so that the subsidiary jet stream 7 is caused to impinge against the main jet stream 3. In an embodiment illustrated in FIG. 4, a subsidiary jet stream 7 of a discontinuous pressure wave is introduced in two directions at right angles to the introduction direction of the main jet stream 3. In this embodiment, each subsidiary jet stream 7 is supplied from a fluid oscillator. The impinging angle of the subsidiary jet stream 7 need not be exactly at a right angle to the introduction direction of the main jet stream 3.

The oscillation frequency of the subsidiary jet stream 7 is not particularly critical, but in the case of uncrimped yarns, in order to maintain the continuous vibrations of the yarns, it is preferable to adopt an oscillation frequency corresponding to an intergral multiple or integral fraction of the frequency of the sinusoidal vibration of the filamentary yarn. The frequency is determined by the denier (linear density) of the multifilament yarn, and the distance between guides disposed in the running direction, to control the yarn and the tension on the yarn being treated.

As means for obtaining oscillating fluids, one may use not only pure fluid elements, such as known load type oscillators, edge tone type oscillators and sonic oscillators, but also, diaphragms operated by an electromagnetic force.

Figure 5:
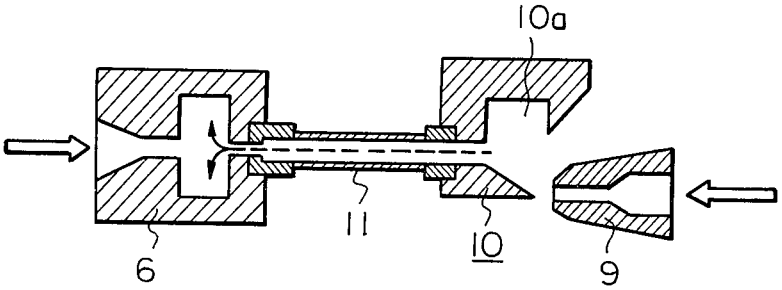
FIG. 5 is a schematic cross-sectional view of a practical yarn treating device, according to the present invention.

FIG. 5 is a diagram illustrating a first embodiment of the apparatus for use in carrying out the present invention, in which a known fluid oscillator 10, such as an edge tone oscillator, is connected to a yarn treating member 6 of a fluid treating means for jetting a continuous jet stream as shown in FIGS. 3 and 4.

Figure 6:
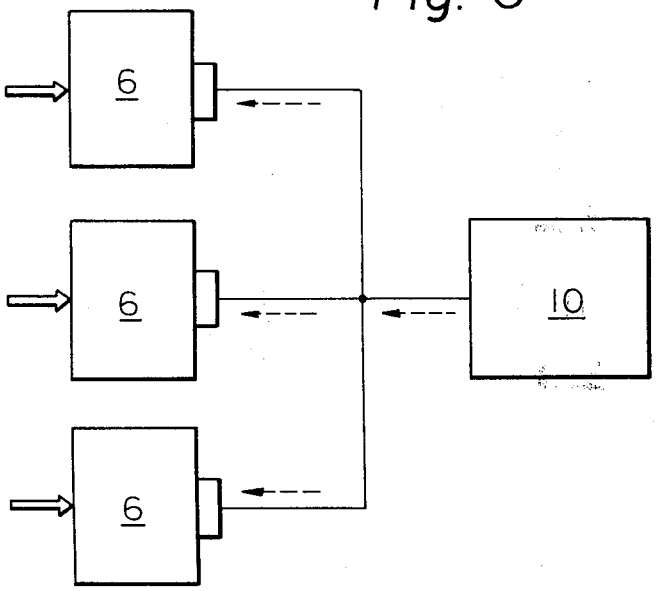
FIG. 6 is a schematic side view illustrating how to connect a plurality of yarn treating devices with a fluid oscillator, according to the present invention.

One fluid oscillator 10 is connected to each yarn treating member 6 as shown in FIGS. 3 and 4, and the basic structure of the apparatus of the present invention comprises the oscillator 10 and yarn treating member 6. As will be apparent to those skilled in the art, when the present invention is used with yarn manufacturing equipment or yarn processing equipment in a yarn manufacturing factory, a number of the fluid treating means corresponding to the number of multifilament yarns to be treated is necessary. In this case, a plurality of yarn treating members 6 may be connected to one fluid oscillator 10 as shown in FIG. 6.

Figure 7:
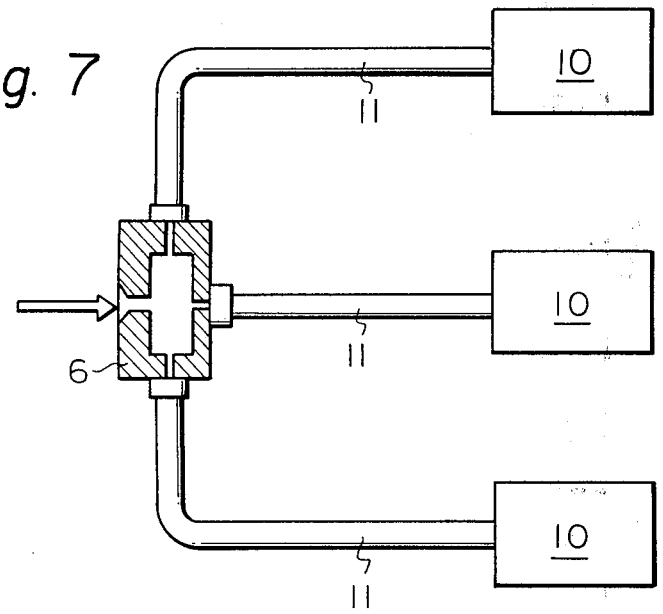
FIG. 7 is a schematic side view illustrating how to connect a yarn treating device with a plurality of fluid oscillators.

When two or more discontinuous subsidiary jet streams are jetted in the yarn treating zone as shown in FIG. 4, it is preferred that one fluid oscillator 10 be connected to each of the nozzles for jetting the discontinuous jet streams independently as shown in FIG. 7. The reason for this is that when using more than one fluid oscillator, if the fluid oscillating frequency differs in the respective fluid oscillators, discontinuous subsidiary jet streams differring in oscillating frequency will be simultaneously jetted into the yarn treating zone and the phase of the pressure wave will deviate in the separate subsidiary jet streams. Thus, optimum conditions for the interlacing treatment can easily be created if any one fluid oscillator is used.

In FIG. 8A there is illustrated a second embodiment of the apparatus fo carrying out the present invention, in which the yarn treating member 6 of the apparatus is arranged so that a function of generating an oscillating stream is exerted by the yarn treatment member itself. More specifically, a resonance chamber 7 is part of the yarn treating member 6 and it confronts the main jet stream 3. The resonance chamber 7 constitutes a so-called load type oscillator which generates a discontinuous pressure wave when the main jet stream 3 is jetted therethrough. In this embodiment, since it is indispensable that the resonance chamber 7 should generate an oscillating stream of a low frequency, it is preferred to adopt a structure of a Helmholtz resonator in which a fluid receiving opening 8 of the resonance chamber 7 is throttled as shown in FIG. 8B.

In an embodiment illustrated in FIG. 8C, a side hole **4*a* is opened to the side portion of the jetting opening 4 of the apparatus as shown in FIGS. 8A and 8B. A liquid, such as water, is introduced frm side hole 4*a* and it is fed to the yarn treating zone 5 together with the main jet stream 3**. The liquid acts in the atomized state on the running multifilament yarn together with the jet stream, whereby the effect is to enhance the coherence of the running multifilament yarn.

In the above-mentioned treatment for interlacing a running multifilament yarn by a jetted fluid stream, a higher cohering property can generally be imparted to the yarn as the energy of the fluid jetted to the yarn is large. As means for enhancing the energy of the fluid, the can be adopted a method in which a liquid is present in the atomized state in the jetted fluid stream as in the embodiment shown in FIG. 8C.

Further, in general, in order to increase the energy of the fluid, the speed of the fluid jetted from the jetting opening of the nozzle is elevated and the feed pressure of the fluid is increased, so as to attain a high jetting speed of the fluid. Still further, in order to increase the momentum of the fluid, the diameter of the jetting opening may be increased or the number of jetting openings may be increased. However, when a compressible fluid, especially compressed air, is used as the fluid to be jetted, it has been believed that it is impossible to elevate the speed of the fluid at the nozzle exit beyond the sonic velocity unless a divergent nozzle (Lavel nozzle) is used.

According to the present invention, this object can be conveniently attained by using at least two nozzles differing in cross sectional area and disposed coaxially with each other as the fluid supply nozzle. These nozzles differing in cross sectional area are arranged so that the sectional area of the nozzle disposed on the fluid introduction side is smaller than the cross sectional area of the nozzle disposed on the fluid discharge side.

More specifically, in accordance with one preferred embodiment of the present invention, a two-staged nozzle assembly, including nozzles differeing in diameter, is used as the fluid supply nozzle and the cross sectional area of the first-stage nozzle on the fluid introduction side is smaller than the cross sectional area of the second-stage nozzle on the fluid discharge side. The foregoing object of increasing the quantity of the fluid energy can be effectively attained according to this preferred embodiment of the present invention.

Figure 11:
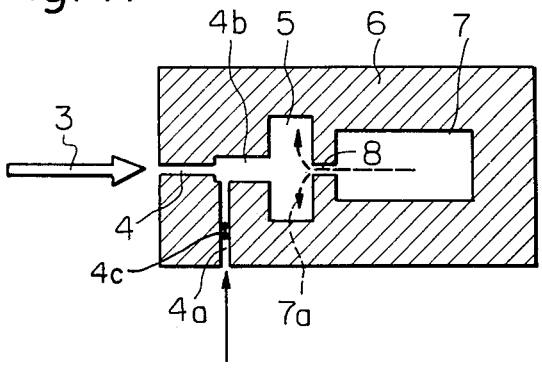

This embodiment will now be described in more detail with reference to the drawings. As shown in FIG. 9, the nozzle system for supplying a jet stream of a fluid comprises a straight nozzle 4 of the first stage, which is provided with a circular transversal cross-section, and a nozzle 4b of the second stage disposed coaxially with the first-stage nozzle 4, which is provided with a diameter larger than that of the first-stage nozzle 4. Further, as shown in FIG. 10, the above-mentioned fluid-introducing aperture 4a may be formed on the first-stage nozzle 4, and as shown in FIG. 11, the fluid-introducing aperture 4a may be formed just after the first-stage nozzle 4, namely on the second-stage nozzle 4b. In this case, a negative pressure generated just after the first-stage nozzle 4 is utilized for positively sucking the fluid from the fluid-introducing aperture 4a. This negative pressure generated just after the first-stage nozzle 4 can be controlled by adjusting the amount of the fluid introduced from the fluid-introducing aperture 4a. More specifically, this control can be accomplished by providing a valve 4c capable of adjusting the cross sectional area of the fluid-introducing aperture 4a midway thereof, or attaching a commercially available flow rate adjusting valve (not shown) to the top end of the fluid-introducing aperture 4a. In order to facilitate this control of the pressure of the atmosphere just after the first-stage nozzle 4, it is preferred to adopt a structure in which an expansion chamber 12 is disposed between the first-stage nozzle 4 and the second-stage nozzle 4b, as in an embodiment shown in FIG. 12.

When a compressible fluid is used as the operating fluid, as pointed out hereinbefore, a Lavel nozzle may be conveniently used as the means for elevating the speed of the fluid. In the present invention, by adopting a two-stage nozzle system, as described above, a phenomenon similar to one caused by a Lavel nozzle can be caused and the fluid energy can be increased by this phenomenon. More specifically, the compressible fluid jetted from the first-stage nozzle 4 flows into the second-stage nozzle 4b having a diameter larger than that of the first-stage nozzle 4 to allow expansion of the jet stream, and by adjusting the pressure of the atmosphere just after the first-stage nozzle 4, by appropriate means as described above, expansion of the jet stream jetted from the first-stage nozzle 4 can be controlled to an optimum degree according to the diameter of the second-stage nozzle 4b.

As will be apparent from the foregoing illustration, in the present invention, by adoption of the above-mentioned two-staged nozzle system, the speed of the jet stream can be enhanced and the energy of the fluid can be increased.

The jet stream introduced in the second-stage nozzle 4b undergoes rectifying action in the second-stage nozzle 4b and is, then, jetted into the yarn treating zone 5 through the outlet of the second-stage nozzle 4b. The fluid jetted from the outlet of the second-stage nozzle 4b takes the form of parallel streams. These jet streams are both temporarily and spatially stable and can be applied to the running filamentary yarn passing through the yarn treating zone 5.

Furthermore, since the cross sectional area of the second-stage nozzle 4b opened to the yarn treating zone 5 is larger than that of the first-stage nozzle 4, the frequency of impingement of jet streams against the running yarn passing through the yarn treating zone 5 is increased, and as a result, the energy of the jetted fluid can be imparted to the multifilament yarn at a high efficiency.

As illustrated in the foregoing embodiments, by virtue of the feature that a resonance tube is disposed coaxially with the fluid jetting nozzles 4 and 4b to confront these nozzles, an oscillation can be generated in the fluid. When the discontinuous pressure wave 7a is caused to impinge against the continuous main jet stream 3, the force of the main jet stream 3 is discontinuously moderated. Accordingly, the running multifilament yarn is allowed to move in the jetting direction of the main jet stream 3. Namely, the running yarn is allowed to impinge against the main jet stream, and as a result, the energy of the jetted fluid can be imparted to the yarn at a high efficiency.

By the action of the resonance tube, not only a fluid oscillation of a relatively low frequency in the audio frequency region but also an ultrasonic oscillation should naturally be generated. The liquid jetted into the yarn treating zone 5 through the introducing aperture 4a together with the main jet stream 3 is atomized to fine particles of a micron unit by the so generated ultrasonic oscillation, and especially when the main jet stream 3 is composed of compressed air. The momentum of the jet stream is increased by such atomized liquid and the energy of the jetted fluid can be effectively imparted to the running yarn. Further, the liquid atomized to fine particles of a micron unit adheres to the running multifilament yarn at a high efficiency, and when the atomized liquid contains water, there can be attained an effect of increasing the friction among individual filaments of the running yarn, and hence, the coherence property of the yarn can be further improved.

Figure 13:
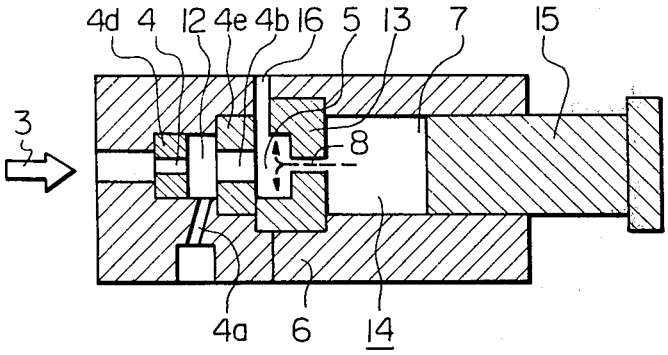
FIG. 13 is a transversal cross-sectional view of one of the typical yarn treating devices according to the present invention.

Referring to FIG. 13, a yarn treating zone 5 is disposed in the central portion of a housing 6 and a fluid supply nozzle system is located on one side of the housing 6. This nozzle system comprises a first-stage nozzle 4 and a second-stage nozzle 4b. These nozzles 4 and 4b are processed into nozzle pieces 4d and 4e, respectively, and they are arranged so that they can be dismounted from the housing 6. An expansion chamber 12 having a diameter larger than the diameter of the first-stage nozzle 4 is interposed between the two nozzle pieces 4d and 4e. This expansion chamber 12 is communicated with the outside through an introducing conduit 4a, and a throttle valve may be mounted on an inlet end of the introducing conduit 4a according to need.

The yarn treating zone 5 is composed of a piece 13 arranged dismountably from the housing 6 and a resonance tube 14 is disposed in the proximity of the piece 13. The resonance tube 14 includes a cavity portion 7 and a neck portion 8 having a diameter smaller than that of the cavity portion 7. A piston 15 is fitted in the cavity portion 7. The piston 15 can make a reciprocating motion in the cavity 7 and the volume of the cavity 7 can be fixed by appropriately setting the position of the piston 15. The neck portion 8 is formed to pierce through the piece 13. The first-stage and second-stage nozzles 4 and 4b of the fluid supply nozzle system, the neck portion 8 of the resonance tube 14 and the cavity portion 7 of the resonance tube 14 are disposed coaxially with one another.

A slit 16 for threading the yarn, which is communicated with the outside, is formed in the yarn treating zone 5 to facilitate the operation of threading the yarn into the yarn treating zone 5. A part of the yarn treating zone 5 defined by the inner wall parallel to the running multifilament yarn is constructed as the yarn-threading slit 16 and is always in communication with the outside as shown in FIG. 13. As the width of the slit is smaller than zone 5, the influence on the yarn-interlacing treatment should naturally be reduced accordingly. It is preferred that the yarn-threading slit be closed during the treatment. Namely, it is preferred to adopt an arrangement in which a part of the yarn treating zone is opened in a slit-like shape in parallel to the running direction of the yarn when the yarn is threaded into the treating zone and this slit is closed during the interlacing treatment. Various means may be considered for attaining this arrangement. A specific example of such means will now be described with reference to FIG. 14.

Figure 14:
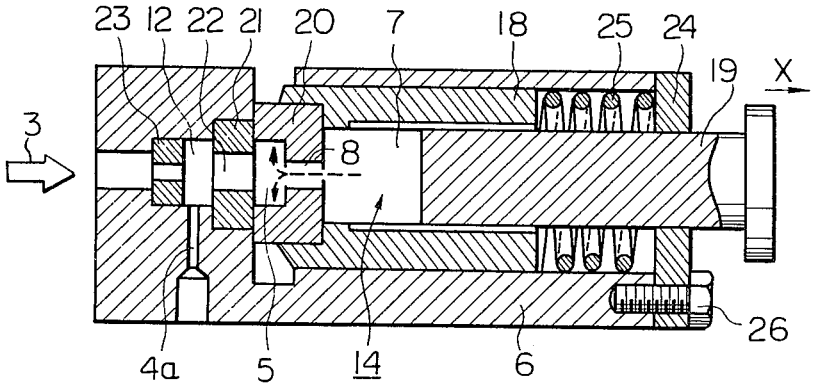
FIG. 14 is a transversal cross-sectional view of a modification of the device shown in FIG. 13.

Referring to FIG. 14, a resonance tube 14 includes a housing 18, a piston 19 fitted to the inner face of the housing 18 from one end thereof and a piece 20 fitted to the inner face of the housing 18 from the other end, which constitutes the neck portion 8 of the resonance tube. In this embodiment, the yarn treating zone 55 is defined by the piece 20 and a second-stage nozzle piece 21, and the piece 20, including the neck portion 8, acts as a yarn passage piece.

The first-stage nozzle piece 23, the second-stage nozzle piece 21 and the resonance tube housing 18 constituting the resonance tube 14 and yarn treating zone 5 are mounted coaxially on the housing 6 having a yarn threading slit-like opening parallel to the yarn running direction at the position corresponding the exit of the second-stage nozzle 21. This construction constitutes the main portion of the fluid treatment apparatus.

A compression coil spring 25 is disposed between a pressing plate 24 and the wall of the resonance pipe housing 18 on the side opposite to the yarn passage piece 20. The pressing plate 24 is mechanically attached to the housing 6 by means of a fastening member 26, such as a bolt. Both the first-stage nozzle piece 23 and the second-stage nozzle piece 21 are tightly fixed through strong fitting or by using an adhesive. The yarn passage piece 20 is fixed to the resonance tube housing 18 by being tightly fitted or by using an adhesive. The piston 19 may similarly be fixed to the resonance tube housing 18 through tight fitting or by using an adhesive, but in order to change the frequency of the fluid oscillation easily in accordance with yarn treating conditions, it is preferred that the piston 19 be fitted to the resonance tube housing by means of screw threads formed on the inner face of the housing 18 which receive a male screw formed on the outer face of the piston 19. In the structure shown in FIG. 14, the compression coil spring 25 presses the second-stage nozzle piece 21 and the yarn passage piece 20 to each other, so that the yarn treating zone 5 is covered by the inner wall parallel to the yarn running direction and the opening, such as a slit, is closed during the treatment.

When the yarn is threaded into the treating zone 5, the piston 19 is pulled in a direction indicated by arrow X to move the resonance tube 14 in the axial direction together with the yarn passage piece 20, whereby an opening is formed between the yarn passage piece 20 and the second-stage nozzle piece 21, and the yarn threading-in operation can be performed very easily through this opening.

In the apparatus of the present invention, the nozzle may be straight in the axial direction, or there may be employed a nozzle tapered so that the cross sectional area on the fluid discharge side is larger than the cross sectional area on the fluid introduction side.

In the apparatus of the present invention, not only a continuous main jet stream but also an oscillating pressure wave by the above-mentioned fluid-oscillating action is generated, and the oscillating pressure wave is caused to impinge against the main jet stream. The running yarn is exposed to the resulting impinging streams to impart a high cohering property to the yarn.

The oscillation frequency of the fluid is determined by the feed pressure of the jet stream, the back pressure at a point just after the first-stage nozzle 23, the length and diameter of the neck portion 8 and the volume of the cavity portion 7. Since the volume of the cavity portion 7 can be freely adjusted by the piston 19, the oscillation frequency of the fluid can be optionally controlled.

In the embodiments shown in FIGS. 8A, 8B and 9, the fluid treatment apparatus does not include an introduction aperture 4*a* opened to the nozzle. Accordingly, in these embodiments, the pressure of the fluid at the inlet of the resonance tube is determined by the feed pressure of the fluid. This means that if the dimensions of the fluid treatment apparatus are set, the oscillation frequency region of the fluid is substantially determined by the feed pressure of the fluid, and it has been found that when treatment conditions such as the feed pressure of the fluid are changed, it sometime happens that an oscillation of a desired frequency is not generated in the fluid.

Figure 12:
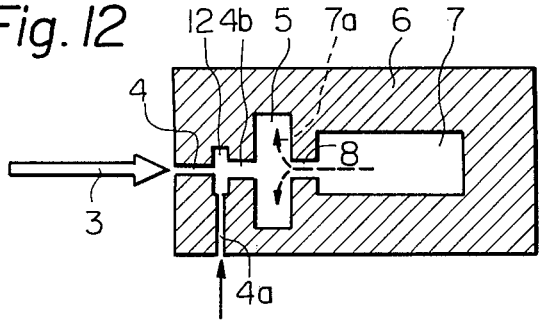
FIG. 12 is a transversal cross-sectional view of a further modified yarn treating device, wherein an expansion chamber is provided at a position upstream from the main nozzle, according to the present invention.

In contrast, in the case where an introduction aperture opened to the nozzle is formed as in the embodiments shown in FIGS. 8C and 10 to 14, the above disadvantage can be obviated by adjusting the quantity of the fluid introduced from this introduction aperture. This effect is especially conspicuous when the introduction aperture is disposed just after the first-stage nozzle as shown in FIGS. 11 and 12.

Another important effect attained by provision of this introduction aperture is the ability to adjust the sharpness of the fluid oscillation, i.e., the resonance sharpness. In the case where no introduction aperture is formed, the sharpness of the fluid oscillation is generally determined by the feed pressure of the fluid alone. In contrast, in the case where an introduction aperture is formed, it is possible to adjust the sharpness of the fluid oscillation, for example sharpen or dull the fluid oscillation, by adjusting the quantity of the fluid to be introduced. For example, the fact that the fluid oscillation is dull means that the energy of the fluid is sufficiently present in a relatively broad range of frequencies with the oscillation frequency being the center, and the fact that the fluid oscillation is sharp means that the fluid energy is concentrated in a very narrow range of frequencies very close to the oscillation frequency.

In the treatment method of the present invention, especially good results are obtained when the oscillation frequency of the discontinuous jet stream, i.e., the oscillating fluid, is controlled substantially to an integral multiple or integral fraction of the inherent frequency of the sine oscillation of the multifilament yarn, and it is preferred that the resonance sharpness (quality factor Q) of the fluid oscillation be at least 2. The resonance sharpness Q is defined as follows.

Figure 15:
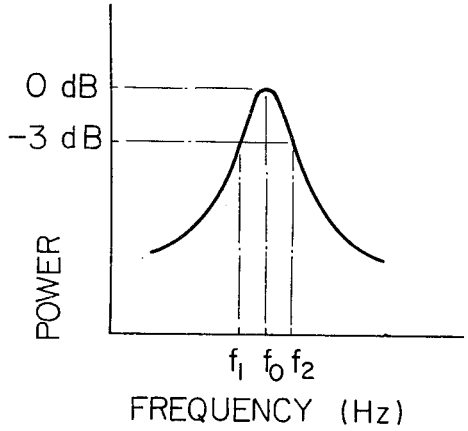
FIG. 15 is a diagrammatical representation indicating the power spectrum of the fluid oscilation.

In the power spectrum of the fluid oscillation shown in FIG. 15, the frequency at the peak is represented by $f_0$ (Hz) and the frequencies $f_1$ and $f_2$ (Hz) at points where the power values are smaller by 3 dB than the peak value are determined. Then, the resonance sharpness Q is calculated according to the following equation.

$$Q = \frac{f_0}{|f_1 - f_2|}$$

Since the theory regarding the resonance sharpness Q is clearly shown in "Shock and Vibration Handbook" (Vol. I, Chapter 2, Basic Vibration Theory), written by Harris and Crede, Published by McGraw-Hill, U.S.A., in 1961, a detailed explanation of the resonance sharpness is omitted here.

The pressure of the oscillating fluid is determined in the present invention in the following manner.

Figure 16:
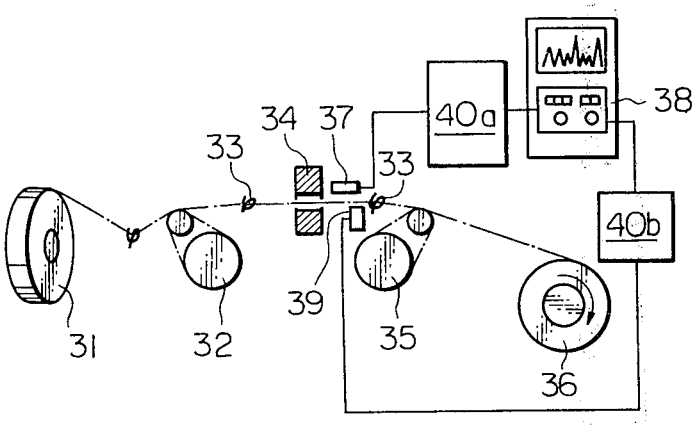
FIG. 16 is a schematic side view of a device for measuring the fluid pressure of the oscillating fluid, to test the functional effect of the device according to the present invention.

In an apparatus shown in FIG. 16, the feed speed of a multifilament yarn 31 is set by a feed roller 32, and the yarn 31 is passed through interlacing means 34 (nozzle) disposed between guides 33, and wound through a feed roller 35 by a winder 36. The interlacing means 34 is set between the two guides 33 and the distance between the guides 33 is represented by l. A pressure transducer 37 is disposed on the jetting opening to measure the frequency of an oscillating stream generated by the device 34, and a signal from the pressure transducer 37 is analyzed by a real-time frequency analyzer 38 to determine the frequency.

The frequency of the sine vibration of the filamentary yarn is similarly determined. More specifically, the running multifilament yarn is caused to fall into contact with the diaphragm surface of another pressure transducer 39, and a signal from the pressure transducer 39 is analyzed by the real-time frequency analyzer 38 to determine the frequency.

The pressure transducer 37 (Semiconductor Subminiature Pressure Transducer, type PMS-5, 2H-1146M produced by Toyoda Machine Works Ltd., Japan U.S. Pat. No. 3,505,874) is used as a sensor and a diaphragm of the pressure converter 37 acting as a pressure-receiving member is arranged so that the axial line of the diaphragm coincides with the axial line of the running direction of the yarn. The pressure of the fluid discharged from the yarn treating zone is measured by this assembly. The pressure transducer 37 is connected to the frequency analyzer 38 (Ubiquitous Spectrum Analyzer, Type UA-500, produced by Federal Scientific Corp., New York, U.S.A.) through an amplifier 40 (Measuring Amplifier, type 2606, produced by Brüel & Kjar, Denmark) to produce a power spectrum of the fluid pressure. Since the above-mentioned book "Shock and Vibration Handbook" contains a detailed explanation regarding the term "power spectrum", in Vol. I, Chapter 11, pages 11-5 through 7 and Vol. II, Chapter 22, pages 22-15 through 20, the detailed explanation thereof is omitted here.

In the case of a yarn crimped by the false-twisting treatment, when the distance l between the two guides is relatively long, as compared with the intended length of the opening zone, the above-mentioned proper vibration frequency is not definite. The reason for this is that, since crimps are formed on the individual filaments of the yarn, the freedom of the yarn is large and hence, a sine vibration in the strict sense of the term is hardly caused in the yarn. In this case, it is preferred that the distance l between the guides be set in the range of $0.5P \leqq l \leqq 1.5P$, where P represents the intended length of the opening zone, which corresponds substantially to the interlacing pitch, and that the resonance sharpness be low.

In the case of an uncrimped multifilament yarn, the above-mentioned proper vibration frequency of the running yarn (an integral multiple or integral fraction of the vibration frequency) is not always constant but is changed depending on such factors as the thickness variation of the running yarn, the degree of coherence of the supplied yarn to be treated, the degree of the interlacing treatment and variations of the treatment tension. If the vibration frequency of the running yarn is set at this inherent vibration frequency, the running yarn can be oscillated stably.

With regard to the fluid oscillation, it is preferred that the frequency of the fluid oscillation should not be such that it includes a sharp single basic oscillation frequency and frequencies corresponding to integral multiples of the basic frequency, but that it be such as to have energy components of respective frequencies, as seen in an energy spectrum of white noise, and includes the above-mentioned inherent oscillation frequency. In this case, no particular attention need be paid to the degree of the resonance sharpness. Of course, as will be apparent to those skilled in the art, when treatment conditions such as the kind of the yarn, the yarn speed, the distance between the guides and the treatment tension are changed, the optimum values of the proper vibration frequency and resonance sharpness are changed accordingly.

As pointed out hereinbefore, a continuous stream (main jet stream) impinges against a discontinuous pressure wave formed by the action of the resonance tube in the yarn treating zone and an oscillating fluid stream flows out from an opening of the inlet or outlet of the yarn treating zone. The resonance sharpness (quality factor Q) of oscillating fluid stream at a predetermined point in the vicinity of the inlet or outlet of the yarn treating zone (for example at a point 15 mm apart from the axial line of the nozzle) is measured. This quality factor is mainly determined by the resonance sharpness in a Helmholtz resonance tube, which is influenced by the pressure of the atmosphere at the inlet of the resonance tube.

In the treatment apparatus shown in FIGS. 8A, 8B and 8C, the quality factor (Q value) is determined exclusively by the nozzle dimensions (such as the nozzle diameter, the distance between the outlet of the nozzle and the inlet of the resonance tube, the size of the section of the yarn passage and the length of the yarn passage in the longitudinal direction) as prescribed conditions and the fluid supply pressure, one of the treatment conditions. In an extreme case, also the pressure of the resulting oscillation is exclusively determined by the fluid supply pressure. Accordingly, it is extremely difficult to obtain a desired oscillation state at a desired fluid supply pressure.

In the embodiment shown in FIGS. 12, 13 and 14, the quality factor is determined by: (1) the nozzle dimensions as prescribed conditions; (2) the fluid supply pressure as the treatment condition, and; (3) the pressure (the degree of vacuum) of the atmosphere in the expansion chamber 12, which is a factor adjustable during the treatment.

With regard to the condition (3), mentioned above, by adjusting the pressure of the atmosphere in the expansion chamber 12, it is possible to control the degree of expansion of the jet stream jetted from the nozzle, and therefore, it is possible to adjust the pressure of the atmosphere at the inlet of the resonance tube. As specific means for performing the adjustment (3), there can be mentioned a method in which the amount of a fluid (air in this case) sucked and flowed from the introduction aperture 4*a* is controlled to attain a desired pressure. For example, a flow rate control valve is connected to the introduction aperture 4*a* or the cross-sectional area of the introduction aperture 4*a* is partially reduced by utilizing a screw (bolt) piercing up to the housing.

The quality factor of the oscillation, i.e., the resonance sharpness, is determined based on the above factors according to the pressure of the atmosphere at the inlet of the resonance tube. Of course, in the actual treatment, also the resonance frequency is an important factor and it is necessary to adjust the volume of the resonance tube so that a desired frequency is attained. In this case, if the frequency is changed, the quality factor is sometime changed subsidiarily. In such a case, it is possible to obtain the desired oscillation frequency and quality factor (oscillation sharpness) under a desired fluid supply pressure by adjusting both the quantity of the fluid introduced from the introduction aperture 4*a* and the volume of the resonance tube.

The present invention will now be described in detail by means of the Examples set forth below. In these Examples, the coherency factor CF-I means the degree of interlacing determined according to the method described below, and the coherency factor CF-II means the degree of interlacing as measured by an Entanglement Tester (Type 2040), manufactured by Rothschild Co. (Switzerland). Experiments in these Examples were conducted in an atmosphere of the same temperature and relative humidity by using the same compressed air stream. Accordingly, in each experiment the degree of interlacing was measured in an atmosphere of the same temperature and relative humidity on the same rod. In the case of measuring the interlacing degree CF-II by the tester type 2040, of Rothschild Co., the tension of the running yarn and the trip level were maintained at the respective conditions, for example, 14 g and 20 g for the running yarn of nylon 70 denier/24 filaments.

EXAMPLE 1

In this Example, an apparatus comprising a single-stage nozzle and a fluid oscillator consisting of a Helmholtz resonator, as shown in FIG. 8B, and an apparatus comprising a two-stage nozzle 4, 4*b*, an expansion chamber 12, an introduction aperture 4*a* and a fluid oscillator consisting of a Helmholtz resonator, as shown in FIG. 13, were used as the apparatus of the present invention. An apparatus as shown in FIG. 2C was used as the comparative apparatus. In each of these three apparatuses, the section of the treatment zone had a rectangular shape having a long side of 2.5 mm and a short side of 1 mm, and the diameter of the fluid jetting opening 4 was 0.8 mm and the opening 4 was located at the center of the long side.

In these experiments, uncrimped nylon yarns were used. As pointed out hereinbefore, in the case of uncrimped yarns, a better effect can be attained if the oscillation frequency of the subsidiary jet stream is adjusted to an integral multiple or integral fraction of the proper frequency of the sinusoidal vibration of the multifilament yarn being treated. For example, in the case of 70-denier nylon multifilament yarn, if the distance l between the guides as shown in FIGS. 1A, 2 and 16 is 15 cm and the yarn tension is 5 g, the primary inherent frequency f is given by the formula:

$$f = \frac{1}{2l}\sqrt{\frac{T}{\rho}} \text{ (Hz)}$$

wherein $\rho$ represents the linear density, which is calculated from the density d of 1.14 g/cm$^3$ in case of nylon. When the value f is calculated according to the above formula, a value of 265 Hz is obtained. This frequency is included in a relatively low frequency region. In actual application, the frequency of the fluid oscillation is set to an integral multiple of the so calculated primary inherent frequency. The proper frequency of the sine vibration is actually determined according to the method shown in FIG. 16.

The experiments were carried out under conditions shown in Table 1 to obtain the results shown in Table 2. In this case, the theoretical primary proper frequency $f_0$ of the sinusoidal vibration of the nylon yarn was 265 Hz.

TABLE 1

| | |
|---|---|
| Treated yarn | 70-denier 24-filament multifilament yarn |
| Tension on running yarn | 5 g |
| Yarn speed | 200 m/min |
| Distance between guides | 15 cm |
| Feed air pressure | 3 Kg/cm$^2$ |
| Amount of air consumed | 18 l/min |

TABLE 2

| | Treatment Apparatus | | | | | |
|---|---|---|---|---|---|---|
| | Comparison | Present Invention (FIG. 8-B) | | | Present Invention (FIG. 13) | |
| | (FIG. 2-C) | A | B | C | B' | C' |
| Run No. | 1-1 | 2-1 | 2-2 | 2-3 | 3-1 | 3-2 |
| Frequency f (Hz) of fluid | — | 800 | 500 | 330 | 500 | 330 |
| $f/f_0$ | — | 3 | 1.9 | 1.25 | 1.9 | 1.25 |
| Coherency factor CF-I | 13 | 32 | 26 | 27 | 41 | 35 |

In runs using the apparatus of the present invention as shown in FIG. 8B (runs Nos. 2-1, 2-2 and 2-3), which had a single-stage nozzle and a resonance tube, the coherency factor CF-I was about two to about three times the interlacing degree attained by the conventional apparatus (FIG. 2C) when the frequency of the fluid oscillation was close to an integral multiple of the proper frequency of the sinusoidal vibration of the yarn.

In runs of the present invention using the apparatus comprising a two-stage nozzle, an expansion chamber, an introduction aperture and a resonance tube as shown in FIG. 13 (runs Nos. 3-1 and 3-2), the coherency factor CF-I was increased by 30 to 50% as compared with the coherency factor CF-I attained with the apparatus including the single-stage nozzle and resonance tube (runs Nos. 2-2 and 2-3). When the frequency of the fluid oscillation was close to an integral multiple of the proper frequency of the sinusoidal vibration of the yarn, the effect of improving the interlacing degree was especially high.

EXAMPLE 2

The treatment was carried out under the same conditions as described in run No. 3-2, of Example 1, except that water was sucked from the introduction aperture 4a. The coherency factor CF-I was 93, which is about three times the value of 35 obtained in run No. 3-2 of Example 1.

EXAMPLE 3

By using the same apparatus as used in Example 1, 150-denier 48-filament polyethylene terephthalate crimped multifilament yarn was treated under treatment conditions indicated in Table 3 to obtain the results shown in Table 4.

TABLE 3

| | |
|---|---|
| Treated Yarn | 150-denier 48-filament polyester false-twisted yarn |
| Tension on running yarn | 2 g |
| Distance between guides | 5 cm |
| Feed air pressure | 3 kg/cm$^2$(G) |
| Amount of air consumed | 18 l/min |

TABLE 4

| | Treatment Apparatus | | | | |
|---|---|---|---|---|---|
| | Comparison (FIG. 2-C) | Present invention (FIG. 8-B) | | Present invention (FIG. 13) | |
| Run No. | 5-1 | 6-1 | 6-2 | 7-1 | 7-2 |
| Frequency f(Hz) of fluid | — | 800 | 500 | 800 | 500 |
| Coherency factor CF-I | 40 | 50 | 95 | 70 | 110 |

EXAMPLE 4

The treatment was carried out in the same manner as described in Example 3, except that the distance between the guides was adjusted to 1.6 cm, the tension on the running yarn was 4 g and the intended interlacing pitch P was maintained at 1.6 cm in each Run. The obtained results are shown in Table 5.

TABLE 5

| | Apparatus shown in FIG. 13 | |
|---|---|---|
| Run No. | 8-1 | 8-2 |
| Frequency f(Hz) of fluid | 800 | 500 |
| Coherency factor CF-I | 110 | 150 |

Each of the values of the coherency factor CF-I referred to in the foregoing Examples 1 through 4 was measured according to the following method. A needle-like member was thrust into individual filaments constituting the multifilament yarn substantially at a right angle to the direction of the yarn axis, and the needle-like member was fixed. A certain difference of the tension on the yarn was brought about between both of the sides of the needle-like member to move the yarn in the axial direction thereof and the movement length m (cm) was measured. The coherency factor CF-I is defined as CF-I=100/m.

Figure 17:
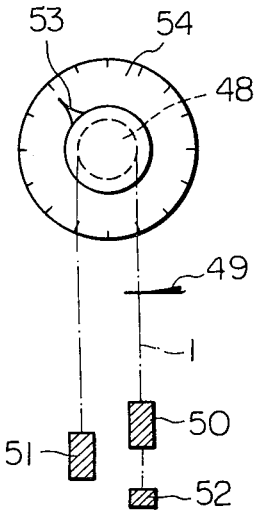
FIG. 17 is a schematic side view of a device for measuring the interlacing degree CF-I, utilized for confirming the functional effect of the yarn treating devices according to the present invention.

The measurement procedures will now be described with reference to FIG. 17, which shows the apparatus for measuring the interlacing degree CF-I.

(1) A multifilament yarn 1 is hung on a running block 48.

(2) A fixing needle 49 is thrust into filaments constituting the multifilament yarn 1 substantially at a right angle to the direction of the yarn axis.

(3) The fixing needle 49 in the state described in item (2), above, is fixed to a wall.

(4) Loads 50 and 51 are attached to both the ends of the multifilament yarn 1.

(5) An auxiliary load 52 is attached to one of the loads 50 and 51.

(6) After the yarn 1 is caused to move against the fixing needle 49 by the auxiliary load and the rotary movement of the running block 48 is stopped, the position of an indicator 53 fixed to the running block 48 is read from a dial 54.

(7) The auxiliary load 52 is separated from one load and is then attached to the other load.

(8) After the movement and rotation are stopped as described in item (6), above, the position of the indicator 53 is read from the dial 54. For this reading and the reading in (6), the total movement distance m (cm) is determined.

The loads 50 and 51 and auxiliary load 52 are set as follows.

In case of uncrimped 70-denier 24-filament nylon multifilament yarns, each of the loads 50 and 51 is set to 14 g [denier number×0.2 g=70×0.2] and the auxiliary load is set to 2.9 g [denier number/filament number=70/24].

In case of crimped 150-denier 48-filament polyethylene terephthalate multifilament yarn, each of the loads 51 and 52 is set to 60 g [denier number×0.4 g=150×0.4] and the auxiliary load 53 is set to 6.3 g [denier number/filament number)×2 g=(150/48)×2 g].

Application of a resonance tube to a fluid treatment apparatus is known from, for example, U.S. Pat. No. 3,167,847. This known apparatus comprises a single-stage nozzle and a coaxially confronting Helmholtz resonator. In this known apparatus, a yarn treating zone defined by inner walls, such as disposed in the embodiments of the present invention, is not formed. In the embodiments of the present invention, an oscillating pressure wave generated by the resonance tube is caused to impinge against a continuous main jet stream ejected from the nozzle in the limited yarn treating zone to form a yarn treating jet stream, and the inner walls of the yarn treating zone are positively utilized so that the multifilament yarn can easily traverse the main jet stream. As pointed out hereinbefore, the frequency of the fluid oscillation is about 1000 Hz or a low frequency lower than 2000 Hz in the present invention. As will be apparent to those skilled in the art, in the apparatus of the present invention, the multifilament yarn always falls in contact with the inner walls defining the yarn treating zone. In contrast, in the apparatus disclosed in the above-mentioned U.S. Pat. No. 3,167,847, no member restricts the movement of the yarn being treated along the passage between the nozzle outlet and the inlet of the resonance tube.

As the yarn speed is enhanced, if it is intended to increase the interlacing pitch the same as during a low yarn speed, it is necessary to cause the yarn to traverse the main jet stream more positively than in case of the low yarn speed treatment. When there is no member restricting the movement of the yarn along the passage between the nozzle outlet and the inlet of the resonance tube, no substantial restoring force by the jet stream can be expected, and in this case, even if the nozzle has a resonance tube, it is extremely difficult to cause the yarn to traverse the main jet stream at a high efficiency.

From the results of comparative experiments where the treatment conditions disclosed in U.S. Pat. No. 3,167,847 were compared with the treatment conditions of the embodiments of the present invention, it was found that in order to utilize the energy of the jet stream at a high effeciency, especially in case of a high speed treatment, it is necessary to dispose a yarn treating zone in such a condition that the yarn being treated is allowed to fall in contact with the inner walls.

In the specification of U.S. Pat. No. 3,167,847, it is disclosed that sympathetic sounds generated by the resonance tube are important, and when the sympathetic sound reaches the maximum, a highest interlacing effect can be obtained. In the present invention, an oscillating stream having a relatively low frequency of about 1000 Hz is caused to impinge against a continuous main jet stream in a yarn treating zone surrounded by the inner walls and the multifilament yarn is interlaced by causing the yarn in the treating zone to positively traverse the main jet stream by this impingement.

The specification of U.S. Pat. No. 3,167,847 teaches that, in order to reduce the level of the sympathetic sound, the nozzle is surrounded by a sound-absorbing material. This sound-absorbing material cannot be an inner wall or the like restricting the movement of the yarn. The reason for this is that, when the yarn falls in contact with such a sound-absorbing material, yarn breakages are caused to occur or fluffs are formed, and the significance of the yarn treatment apparatus per se is lost.

The results of comparative tests where Examples disclosed in the specification of U.S. Pat. No. 3,167,847 were compared with Examples of the present invention are collectively shown in Tables 6-1, 6-2. In each of these experiments, 70-denier 24-filament nylon-6 multifilament yarns were treated. The coherency factor was measured by the Entanglement Tester produced by Rothschield Co. The measured data are shown in the column CF-II in the Table 6-1, below. The coherency factor CF-II is defined as $CF\text{-}II = 100/\overline{m}$, where $\overline{m}$ is a mean value of the length (m in cm) of the nonentangled portion of the yarn measured at 50 portions, randomly taken in the yarn, by the Entanglement Tester.

TABLE 6-1

| Run No. | Remarks 70d–24f | Coherency Factor CF-II | Interlacing Capacity CF-II/K K: (Nl/min) | Yarn speed m/min |
|---|---|---|---|---|
| 1 | run 8 of U.S. Pat. No. 3,167,847 (coherency factor = 72.2) | 31 | 0.54 | 200 |
| 2 | run 11 of U.S. Pat. No. 3,167,847 (coherency factor = 1.4) | 27 | 0.47 | 200 |
| 3-1 | run 18 of U.S. Pat. No. 3,167,847 (coherency factor = 50.4) | 45 | 0.79 | 200 |
| 3-2 | modification of U.S. Pat. No. 3,167,847 | 2 | 0.04 | 600 |
| 3-3 | modification of U.S. Pat. No. 3,167,847 | 10 | 0.18 | 600 |
| 7-1 | present invention (FIGS. 12–13), 830 Hz | 19 | 1.1 | 200 |
| 7-2 | present invention (FIGS. 12–13), 830 Hz | 63 | 3.5 | 600 |

TABLE 6-1-continued

| Run No. | Remarks 70d–24f | Coherency Factor CF-II | Interlacing Capacity CF-II/K K: (Nl/min) | Yarn speed m/min |
|---|---|---|---|---|
| 7-3 | present invention (FIGS. 12–13), 830 Hz | 31 | 1.7 | 600 |
| 8-1 | present invention (FIGS. 12–13), 550 Hz | 33 | 1.8 | 200 |
| 8-2 | present invention (FIGS. 12–13), 550 Hz | 88 | 4.9 | 600 |
| 8-3 | present invention (FIGS. 12–13), 550 Hz | 26 | 1.4 | 600 |
| 9-1 | present invention (FIGS. 12–13), 830 Hz | 72 | 2.6 | 600 |
| 9-2 | present invention (FIGS. 12–13), 830 Hz | 51 | 1.8 | 600 |
| 6-1 | present invention FIG. 8B), 830 Hz | 10 | 0.83 | 200 |
| 6-2 | present invention (FIG. 8B), 830 Hz | 33 | 2.8 | 600 |
| 6-3 | present invention (FIG. 8B), 830 Hz | 25 | 2.1 | 600 |
| 11-1 | (One-step nozzle)+ (Supersonic-Vibration) | 6 | 0.24 | 200 |
| 11-2 | (One-step nozzle)+ (Supersonic-Vibration) | 13 | 0.52 | 600 |

TABLE 6-2

| Run No. | Yarn Tension, (g) upstream Treatment Apparatus | Frequency (f Hz) of Oscillating Fluid | Quality Factor (Q) | Feed Air Pressure Kg/cm$^2$ (G) | Amount of Compress-Air Used K(Nl/min) | Dia, of the first step nozzle (mm) |
|---|---|---|---|---|---|---|
| 1 | 6 | — | — | 4 | 57 | 1.2 |
| 2 | 6 | — | — | 4 | 57 | 1.2 |
| 3-1 | 6 | 210 | 1.4 | 4 | 57 | 1.2 |
| 3-2 | 3 | 210 | 1.4 | 4 | 57 | 1.2 |
| 3-3 | 6 | 210 | 1.4 | 4 | 57 | 1.2 |
| 7-1 | 6 | 830 | 3.0 | 3.0 | 18 | 0.8 |
| 7-2 | 3 | 830 | 3.0 | 3.0 | 18 | 0.8 |
| 7-3 | 6 | 830 | 3.0 | 3.0 | 18 | 0.8 |
| 8-1 | 6 | 550 | 3.2 | 3.0 | 18 | 0.8 |
| 8-2 | 3 | 550 | 3.2 | 3.0 | 18 | 0.8 |
| 8-3 | 6 | 550 | 3.2 | 3.0 | 18 | 0.8 |
| 9-1 | 3 | 830 | 9.8 | 3.0 | 28 | 1.0 |
| 9-2 | 6 | 830 | 9.8 | 3.0 | 28 | 1.0 |
| 6-1 | 6 | 830 | 18.0 | 2.0 | 12 | 1.0 |
| 6-2 | 3 | 830 | 18.0 | 2.0 | 12 | 1.0 |
| 6-3 | 6 | 830 | 18.0 | 2.0 | 12 | 0.8 |
| 11-1 | 6 | — | — | 4.0 | 25 | 0.8 |
| 11-2 | 6 | — | — | 4.0 | 25 | 0.8 |

Runs Nos. 1, 2 and 3 were tracing tests of Examples of U.S. Pat. No. 3,167,847, and in connection with run No. 3, the experiment was repeated by changing the yarn speed to 600 m/min. In the method of U.S. Pat. No. 3,167,847, when the yarn speed was elevated to 600 m/min, the degree of interlacing was drastically lowered. Even if the tension was changed in the range of from 3 to 10 g, the coherency factor was low. In the tests of U.S. Pat. No. 3,167,847, the amount of compressed air used was 57 Nl/min, but in runs Nos. 7, 8 and 9 according to the present invention, the amount of compressed air was 18 Nl/min, in the run No. 9, the amount of compressed air was 28 Nl/min, namely $\frac{1}{3}$–$\frac{1}{2}$ of the amount of compressed air used in U.S. Pat. No. 3,167,847.

In order to evaluate the interlacing effect, the degree of interlacing was divided by the amount of compressed air used and the interlacing capacity per unit flow rate was calculated. In case of U.S. Pat. No. 3,167,847, this value was in the range of from 0.47 to 0.79 when the yarn speed was 200 m/min and the treatment tension was 6 g, but this value was 1.1 to 1.8 in the case of the present invention. Accordingly, it is apparent that the present invention is superior to the invention of U.S. Pat. No. 3,167,847 with respect to the interlacing capacity, i.e., the treatment efficiency.

Further, when the apparatus of the present invention shown in FIG. 8B was used, the value of the above-mentioned interlacing capacity was 2.1 at a yarn speed of 600 m/min, a tension of 6 g and a fluid oscillation frequency of 830 Hz. Accordingly, it is apparent that a very high interlacing effect can be obtained according to the present invention. As pointed out hereinbefore, however, when the apparatus shown in FIG. 8B is employed, the effective pressure generated by oscillation of the fluid is exclusively determined by the dimensions of the nozzle, and it is difficult to change the pressure simply.

In the apparatus shown in FIG. 8A, no fluid oscillation was generated but ultrasonic waves were generated, and the interlacing capacity per unit flow rate was 0.24 at a yarn speed of 200 m/min and a treatment tension of 6 g, or was 0.52 at a yarn speed of 600 m/min and a treatment tension of 6 g. These results are obviously inferior to the above-mentioned results obtained according to the present invention.

As will be apparent from the foregoing illustration, in the embodiments of the present invention, even if the yarn speed is enhanced, the coherency factor is not reduced (when the comparison is made based on the treatment tension of 6 g), and when the method and apparatus of the present invention are adopted, it is possible to interlace multifilament yarn at a high efficiency with a low interlacing energy.

What we claim is:

1. An apparatus for interlacing a multifilament yarn by fluid comprising:
   (a) a yarn treating member;
   (b) a rectangular yarn passage provided through the yarn treating member, through which the yarn to be treated is passed in a continuous running state;
   (c) a fluid supply nozzle provided in the yarn treating member for continuously feeding a jet stream of fluid, one end of the fluid supply nozzle being connected to a fluid supply source, the other end of the fluid supply nozzle being opened to the yarn passage and, the axis of the fluid supply nozzle intersecting the axis of the yarn passage at a substantially right angle;
   (d) a fluid introduction aperture provided in the yarn treating member, one end of the fluid introduction aperture being connected to an introduction fluid source and the other end of the fluid introduction aperture being opened to the fluid supply nozzle;
   (e) fluid exit ports provided only at the inlet and outlet of the yarn treating passage;
   (f) a resonance tube provided in the yarn treating member, one end of the resonance tube being closed, the other end of the resonance tube being opened to the yarn passage with a throttled neck portion and, the resonance tube being disposed coaxially with the fluid supply nozzle through the yarn passage;
   (g) a wall substantially enclosing said yarn passage provided for contact with the moving yarn during the treating of the yarn in the yarn passage with the fluid; and
   (h) a valve for adjusting the quantity of fluid flow to the fluid introduction aperture is provided for controlling the yarn treating fluid to an oscillation of resonance sharpness of at least 2 at the position of the outlet of the yarn passage.

2. A fluid treatment apparatus according to claim 1, wherein said yarn treating passage, fluid supply nozzle and resonance tube are fitted on said yarn treating member so that the axial lines thereof are in agreement with one another and are fixed with respect to the axial directions thereof, a yarn passage piece defining at least part of said yarn passage, elastic means for biassing said yarn passage piece in said yarn treating member to close the yarn passage during operation of the interlacing apparatus and permitting axial movement of the yarn passage piece to open a part of said yarn treating passage in the form of a slit for communication of such passage with the outside for threading of the yarn.

3. A fluid treatment apparatus according to claim 1, wherein a yarn passage piece defines at least part of said yarn passage, the yarn passage piece, the fluid supply nozzle and resonance tube are composed of individual blocks and disposed dismountably in said yarn treating member.

4. A fluid treatment apparatus according to claim 1 including means for freely adjusting the volume of the resonance tube.

5. A fluid treatment apparatus according to claim 1, wherein said fluid nozzle is straight with respect to the axial direction.

6. An apparatus for interlacing a multifilament yarn by fluid according to claim 1, wherein said fluid supply nozzle comprises:
   (a) a first-stage nozzle,
   (b) a second-stage nozzle,
   (c) the cross-sectional area of the second-stage nozzle being larger than the cross-sectional area of the first-stage nozzle, and
   (d) one of the ends of the first-stage nozzle being connected with one of the ends of the second-stage nozzle, and said fluid introduction aperture is opened to the second-stage nozzle.

7. An apparatus for interlacing a multifilament yarn by fluid according to claim 6, wherein an expansion chamber lies between said first-stage nozzle and said second-stage nozzle and, said fluid introduction aperture is opened to the expansion chamber.

8. An apparatus for interlacing a multifilament yarn by fluid according to claim 7, wherein the volume of said resonance tube is adjusted by a piston movably mounted in the resonance tube.

* * * * *

UNITED STATES PATENT AND TRADEMARK OFFICE

CERTIFICATE OF CORRECTION

PATENT NO. : 4,417,375

DATED : November 29, 1983

INVENTOR(S) : Takao Sano, Masafumi Ogasawara and Hiroshi Tsubakimori

It is certified that error appears in the above-identified patent and that said Letters Patent is hereby corrected as shown below:

Column 5, line 8 "inerlacing" should read --interlacing--

Column 6, line 13, "fo" should read --for--

Column 6, line 42, "the" should read --there--

Column 6, line 68, "differeing" should read --differing--

Column 7, line 51, "above, expansion" should read --above. Expansion--

Signed and Sealed this

Ninth Day of April 1985

[SEAL]

*Attest:*

DONALD J. QUIGG

*Attesting Officer* *Acting Commissioner of Patents and Trademarks*